US006691713B1

(12) United States Patent
Altschuler

(10) Patent No.: US 6,691,713 B1
(45) **Date of Patent: *Feb. 17, 2004**

(54) APPARATUS AND METHOD FOR PEST DIAGNOSIS FROM HAIR AND FUR

(75) Inventor: Deborah Z. Altschuler, Newton, MA (US)

(73) Assignee: National Pediculosis Association, Needham, MA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 816 days.

(21) Appl. No.: 09/054,211

(22) Filed: Apr. 2, 1998

Related U.S. Application Data

(60) Provisional application No. 60/050,313, filed on Jun. 20, 1997, and provisional application No. 60/043,900, filed on Apr. 3, 1997.

(51) Int. Cl.[7] ..... A45D 24/00; A45D 24/06

(52) U.S. Cl. ..... 132/200; 132/132

(58) Field of Search ..... 132/114, 119, 132/125, 132, 134, 135, 137, 162, 152, 154, 155, 200; 119/625, 626, 628, 629, 633; 15/143.1

(56) References Cited

U.S. PATENT DOCUMENTS

| | | | | | |
|---|---|---|---|---|---|
| 1,728,152 | A | | 9/1929 | De Bartolo | |
| 1,994,505 | A | | 3/1935 | Dove | |
| 2,408,142 | A | * | 9/1946 | Hollenbeck | 132/137 |
| 2,546,696 | A | | 3/1951 | Mater | |
| 2,553,242 | A | | 5/1951 | Dombitsky | |
| 2,571,205 | A | * | 10/1951 | Cosby | 132/155 |
| 2,610,638 | A | * | 9/1952 | Franklin | 132/119 |
| 3,354,890 | A | * | 11/1967 | Collison | 132/155 |
| 3,368,554 | A | | 2/1968 | Chou | |
| 3,972,528 | A | * | 8/1976 | Mc Cracken et al. | 15/143.1 |
| 4,502,498 | A | * | 3/1985 | Saferstein et al. | 132/137 |
| 4,517,703 | A | * | 5/1985 | Koke | 132/119 |
| 4,974,286 | A | * | 12/1990 | Stowell et al. | 15/143.1 |
| 5,133,101 | A | * | 7/1992 | Hauser et al. | 15/143.1 |
| 5,600,865 | A | * | 2/1997 | Morrison | 132/119 |
| 5,765,253 | A | * | 6/1998 | Martinez | 15/143.1 |

FOREIGN PATENT DOCUMENTS

| | | | | |
|---|---|---|---|---|
| CH | 360465 | * | 4/1962 | 132/125 |
| FR | 626.726 | | 12/1926 | |
| FR | 688.309 | | 1/1930 | |
| FR | 821.975 | | 9/1937 | |
| FR | 827463 | * | 1/1938 | 132/132 |
| FR | 945585 | * | 5/1949 | 132/155 |
| FR | 2681228 | * | 3/1993 | 132/125 |
| GB | 604963 | * | 7/1948 | 132/152 |

* cited by examiner

*Primary Examiner*—Todd E. Manahan
(74) *Attorney, Agent, or Firm*—Choate, Hall & Stewart

(57) ABSTRACT

An apparatus for mechanical removal of pests and their eggs from the hair and fur, and a method for use of the apparatus. The apparatus is in the general shape of a comb having closely separated parallel teeth, which can be passed through the hair to glean lice and nits from the hair. The apparatus may comprise two or more individual combs which can be locked together for use, and separated for cleaning. The apparatus may also comprise a tooth-cleaning mechanism, adapted to be used after each pass of the comb. This mechanism may be, for example, a cleaning member which slides along the teeth to remove pests and eggs. When the apparatus is being passed through the hair or fur, the cleaning mechanism may be disposed at the base of the apparatus to prevent pests from crawling into interior spaces of the apparatus and reinfesting the individual upon subsequent passes of the apparatus through the hair or fur.

5 Claims, 9 Drawing Sheets

APPARATUS AND METHOD FOR PEST DIAGNOSIS FROM HAIR AND FUR

The present application is a Continuation-in-part of U.S. Ser. No. 60/043,900 filed Apr. 3, 1997, and a Continuation of U.S. Ser. No. 60/050,313 filed Jun. 20, 1997, the entire contents of which are incorporated herein by reference.

FIELD OF THE INVENTION

The present invention relates to an apparatus and method for mechanically removing pests, such as lice and nits, from the hair and fur.

BACKGROUND OF THE INVENTION

Traditional methods of controlling pests, such as head lice, their eggs (also known as nits), and the like, require application of a chemical pesticide or pesticides to the hair or fur to kill the pests. Most products using traditional methods include instructions recommending that such treatment should be followed by removal of the dead or dying pests and pest eggs with a comb, because none of the known pesticides are completely ovicidal. For public health reasons, children are not allowed back in school until their hair is demonstrably pest free, therefore it is necessary to remove all traces of such pests, including their egg cases. Combs used with pesticides or as an adjunct to pesticides are, for example, U.S. Pat. No. 2,430,303 (Ruhl) which shows a comb with hollow teeth from which a pesticide can be extruded and U.S. Pat. No. 4,671,303 (Saferstein). The traditional pesticides used, such as lindane, are poisons which can prove hazardous to pregnant women and, especially, to young children. When such pesticides are used on children because parents have little or no alternative method of controlling the pests, physical harm and even death of the child has been known to occur. Additionally, such pesticides are hazardous to the person applying them due to potential absorption through the skin during application or with inhalation. When pesticides are used on an animal, the animal tends to lick its hair or fur, and thus ingest the hazardous chemical(s). Further, the pests which infest hair and fur are becoming resistant to the currently available pesticides, thus reducing or nullifying the efficacy of such methods.

Thus currently, mechanical methods of pest removal, such as combing the hair, are generally used as an ancillary to pesticides or after an individual has been sufficiently exposed to pesticides so that the pests become resistant. Previously, various tools such as short-toothed combs and rake-like combs have been used in an attempt to remove pests and their eggs from the hair on the head of a human. Known combs suffer from several shortcomings, especially when used without pesticides. U.S. Pat. No. 4,502,498 (Saferstein, et. al.); U.S. Pat. No. 4,612,944 (Bachrach, et al.); U.S. Pat. No. 4,671,303 (Saferstein, et al.); U.S. Pat. No. 4,763,675 (DeFelice); U.S. Pat. No. 289,567 (O'Connor et al.); U.S. Pat. No. 307,192 (Saferstein et al.) and U.S. Pat. No. 332,505 (Ward), the disclosures of each of which are incorporated herein by reference; show short-toothed combs which can be used by an individual to remove lice from the hair of another while monitoring efficacy or to remove pests from the individual's hair. Such combs suffer from the inability to remove lice and their eggs from hair of different lengths; the longer the hair, the more inefficient the short-toothed tools are at removal. Further, such combs are difficult for an individual to use without assistance due to the inability of the individual to inspect their own scalp for lice and nits, then pull them out on the comb. Additionally, combs which pull the hair and generate discomfort discourage the user from repeating the combing process until all pests are removed. One example of a comb which tends to cause discomfort is a comb having specialized teeth where one edge is rounded and an opposing edge has an apex for scraping the hair has it passes between juxtaposed teeth, such as shown in U.S. Pat. No. 4,502,498 (Saferstein, et. al.). Combs which cause discomfort generally have the surfaces of the teeth closely coupled either due to the shape of the teeth or due to the positioning of the teeth, one relative to the other, or both. Even when a short-toothed comb is combined with a means to electrify the teeth to kill the lice on contact such as shown in U.S. Pat. No. 5,072,746, nits and egg cases can remain, and then hatch reinfesting the individual providing visual cues suggesting the individual is still infested.

Longer toothed combs for mechanical pest removal are also known in the art. U.S. Pat. No. 2,430,303 (Ruhl); U.S. Pat. No. D 206,476 (Cournoyer); U.S. Pat. No. D 353,915 (Lanne); and foreign patents, GB 604,963 (Royston); U.S. Pat. No. DE 339,538 (Muckenhaupt); and Argentine Industrial Model 057,522 (Burchakchi), each disclosure of which is incorporated herein by reference, show various types of combs having elongated teeth. None of the aforementioned recognize the need to provide for a method for ridding the comb of pests between passages of the comb through the hair or fur. Further, there is a lack of recognition of the need to prevent the harboring of crawling pests or pest eggs in the comb handle or in the space between the teeth so that re-infestation is minimized or eliminated as the comb is repeatedly passed through different sections of the hair.

In use, the aforementioned combs are generally used by one person to comb the hair of a second, seated person. The comb is passed through the hair while the comb handler looks for lice and nits. The comb is again passed through the hair of the seated person until no further pests can be found. Thus, none of the aforementioned prior art which shows long toothed or short-toothed recognizes the need for a tool which can be used effectively without the aid of another person.

It is object of this invention to provide an effective mechanical means to remove pests while minimizing or avoiding the use of a pesticide, both in the case where an individual is assisted and in the case where an individual is unassisted. Additionally, it is an object of the instant invention to provide a means for preventing re-infestation between passages of the comb through the hair. It is a still further object of the instant invention to provide a comb which will not harbor pests so that re-infestation is prevented upon subsequent passages of the comb through the hair or fur. Further, it is an object of the instant invention to provide a comb which can be utilized by a single person for the earliest possible self pest detection, diagnoses and removal, and especially for the removal of the eggs of pests, such as nits. It is a still further object of this invention to provide a tool for pest removal which is easily sanitized and comfortably passed through the hair when self-screening or when performing maintenance after delousing.

SUMMARY OF THE INVENTION

An apparatus for mechanical early detection and mechanical removal of pests and their eggs from hair and fur and a method for use of such an apparatus are provided. In a first embodiment of the apparatus, a single comb is provided. The single comb is comprised of a plurality of elongated, preferably metallic teeth which are closely spaced, yet easily allow passage of a strand(s) of hair in-between each pair; a handle having a base and a base aperture through which the teeth protrude; a means to seal the handle base at the aperture to impede the entrance of pests into the interior portion of the handle; and a means to facilitate cleaning of the spaces between the teeth. Each tooth is substantially round in cross-section and has a blunted end, thus is pin-like in structure. In this embodiment, the means to seal the aperture and the means to facilitate cleaning of the spaces between the teeth is either a combination of a means to clean the spaces between the teeth and means to permanently close the aperture where apertures are present at the base of the comb handle, or a means to clean the spaces between the teeth which temporarily blocks the base during passage of the comb through the hair. The means used to temporarily block the base is referred to herein as a "device for cleaning the spaces between the teeth" and this means also functions to remove pests and their eggs from between the teeth and as a tooth scraping device to remove pests from the teeth between passages of the comb through the infested hair or fur. The means to block the aperture(s) at the base includes a coating, such as for example glue or paint, wherein the means is applied to the aperture in addition to the device for cleaning the spaces between the teeth.

The device to clean the spaces between the teeth is comprised of a substantially planar apparatus having apertures for receiving the teeth. Preferably, each aperture closely fits each tooth and is separated from an adjacent aperture by a wall. However, the aperture may also be baleen-like having a fringed region for contacting the teeth and cleaning the spaces. The apparatus, when in position proximal to the aperture at the base, blocks the aperture. After the comb is passed through the hair or fur, the device for cleaning the spaces between the teeth is transported towards the proximal end of each tooth, thereby scraping pests from between the spaces between the teeth and scraping each tooth, cleaning the comb. Before the next passage through the hair, the device for cleaning the spaces between the teeth is relocated at the aperture at the base, thereby impeding entrance of pests into the aperture during the next passage through the hair or fur. A guide is provided on the apparatus to facilitate correct alignment with the comb teeth. Additionally, the device for cleaning the spaces between teeth thus removing pests and their eggs is equally useful when the comb base is molded of a material, such as plastic, which encases the distal end of the teeth without leaving an aperture. This device may also be positioned on the teeth in closer proximity to their proximal ends, thereby shortening the tooth length which is passed through the hair.

Generally, the teeth are at least about 2 inches in length from proximal to distal end, are closely spaced one to another so that a substantially parallel layer of teeth is provided, and are round and pin-like. Each tooth is at least slightly tapered and blunted at each proximal end, the tooth end which during use is closest to the scalp or skin. This provides for ease of entry of the hair into the spaces between the teeth. Surprisingly and advantageously, less static electricity is produced in the hair or fur as it is combed when the aperture is sealed. Further, unexpectedly pests are more efficiently removed from the hair or fur. A raised or textured area may be present on one or both faces of the comb handle to facilitate gripping of the comb.

In a second embodiment, the apparatus is comprised of at least two of the aforementioned single combs. Each comb has a handle having a base and a plurality of elongated teeth which form a layer and which protrude from the base of the handle. Each has the base of each tooth closely held and sealed at the base of the comb handle. A device for cleaning the spaces between teeth can be seated on each comb individually or the device may accommodate the teeth of each comb simultaneously. Additionally, the apparatus is provided with a fastening means to couple one comb to another so that the teeth of a first layer are shifted relative to the teeth of the second layer. When the teeth are in position for pest removal, the teeth layers of each comb are held substantially parallel one to another with the teeth of the second layer centered substantially over the space between the teeth in the first layer. This pattern of tooth arrangement enhances the amount of surface area contacted on the hair or fur during a single passage with the comb. The fastening means is exemplified by: 1) a pivot pin which is seated at a pivot point in each comb and 2) a device for encasing a portion of each comb so that each comb is fixed into position relative to the adjacent comb.

In the embodiment having the pivot pin, an aperture for receiving the pivot pin and for allowing one comb to rotate relative to the next comb when the pivot pin is in the open position is provided in each of the plurality of combs. The device for cleaning between the spaces may be first removed from the teeth to free them for this rotation. When the pivot pin is in the closed position, the combs are fixed in place so that the layers of teeth are held in place. Herein, each handle of each comb which has a hollow interior has a first exterior face and a second interior face, and each of the exterior and the interior faces has an inside surface and an outside surface. However, when the individual comb has a solid handle, the handle lacks interior faces.

In one aspect of this invention, one or more indentations may be present at a peripheral edge of at least one of a pair of combs to allow insertion of a finger for facilitation of rotation of the mated comb relative to the other comb; or the edges of a comb handle may be textured to facilitate gripping of one of the combs for rotation Guides for rotation of one comb relative to the other comb may be provided. When the fastener means is in the closed or tightened position, each comb is prevented from rotating. Additionally, each of the single combs may have areas proximal to the teeth on each of their respective interior faces to further prevent rotation when the fastener means is in the closed position.

In a third embodiment of the instant invention, a plurality of the aforementioned single combs are held in position by a casing which encloses a sufficient portion of each individual single comb to position the combs in stationary layers where the teeth of one layer are proximal to the space between teeth in the adjacent layer. The casing may enclose only the edges of the handles of each comb or it may enclose a larger proportion of the handles. In each instance, the casing is easily removable to facilitate cleaning of the combs when desired. In a preferred embodiment, a single device for cleaning the spaces between the teeth having apertures situated in layers to accommodate each layer of teeth simultaneously is mounted on the teeth. When a single device for cleaning the spaces between the teeth is used, it further immobilizes the combs one to the other. However, separate devices may be provided on each comb.

Alternatively, a single comb having a handle and a plurality of layers of teeth spaced as provided in the multi-layered comb described above. Again, a single device for cleaning the spaces between the teeth having apertures spaced so as to receive each individual tooth while maintaining its relative position may be mounted on the teeth to reduce the time required for cleaning the comb between passages through the infested hair or fur.

When the comb having a plurality of layers of teeth is used, the individual strand or clump of hair or fur first passes through the space between a pair of teeth in the first comb, then is turned slightly to pass between the space between a pair of teeth in the second comb. Pests gleaned off the hair are either trapped between the combs or are removed onto the surface of the teeth of the upper most comb. When the device for cleaning the spaces between the teeth is moved from the distal end to the proximal end of the plurality of teeth between passages of the comb through the hair, pest removal is facilitated during use, and the possibility of returning live pests and their eggs to re-infest the hair is greatly diminished. Thus, hair or fur is cleaned of pests more rapidly and efficiently.

GENERAL DESCRIPTION OF THE INVENTION

Figure 1:
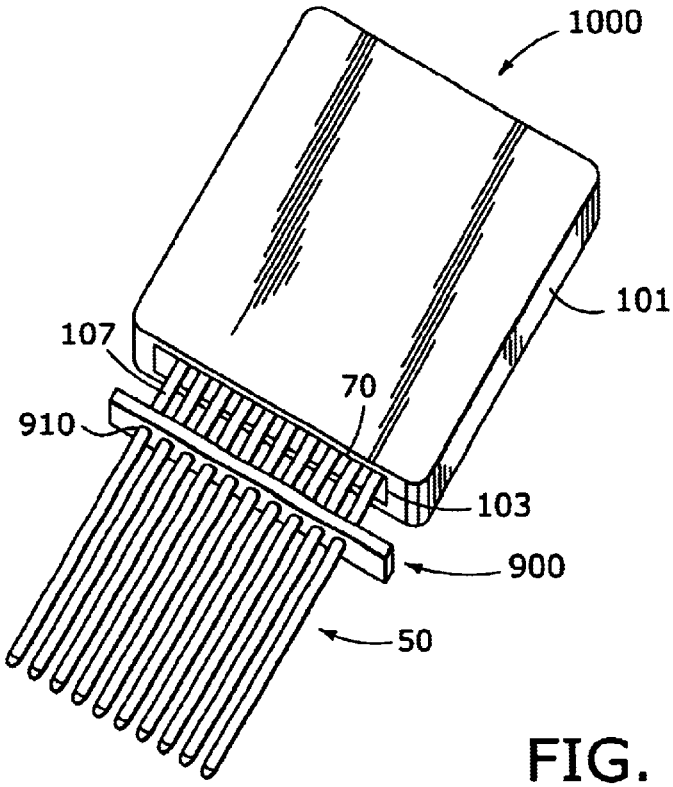
FIG. 1 illustrates an elevational side perspective view of a first embodiment of the instant invention illustrating an apparatus for removing pests, their eggs and their egg cases from hair and fur, wherein a device for cleaning the spaces between the teeth of the apparatus is seated on the apparatus.

The instant invention provides an apparatus and a method of using that apparatus for the mechanical removal of pests, their eggs and their egg cases which facilitates removal of the same and acts to prevent re-infestation of the individual. In one embodiment of the instant invention, the apparatus comprises a comb handle having a plurality of elongated, spaced apart, pin-like teeth arranged in a single layer wherein the handle is sealed around the teeth which is especially useful where one individual is removing infestation in hair or fur of another. In an alternative embodiment, the apparatus comprises a handle means for mounting a plurality of layers of teeth which is especially useful by a single individual for self-removal of infestation from hair. Each is additionally useful for assessment of an infestation of pests, pest eggs, and egg cases. Further, the instant invention provides a device for cleaning the spaces between the teeth between the passages of the teeth through the infested hair or fur, which is mounted on the teeth.

The rounded, pin-like teeth are elongated, ending in a blunt, slightly tapered point. The shaft of each tooth may be solid or partially hollowed, as long as each tooth remains substantially straight while passing through hair or fur which is infested. Preferably, each tooth is greater than one and one half inches in length and is made of metal. However, plastic teeth are contemplated. Most preferably, the teeth are spaced apart from one another, so that a hair or a few strands of hair is able to pass between two teeth comfortably. Each tooth has an approximate diameter of about 0.025 to about 0.075 inches. Preferably, each tooth is substantially round in cross-section and has a diameter of about 0.030 to about 0.035 inches. Most preferably, each tooth is comprised of metal such as for example stainless steel.

The handle or handle means is made of a stiff material such as plastic, nylon, rubber or metal and may be hollow or solid. The shape and weight of the handle may be any configuration which allows the handle to be comfortably held and substantially enclosed in the palm of the hand such as for example rounded or squared. When the handle is hollow, it forms a shell from which the teeth protrude from the central portion of the handle base. An area without teeth may be present at the base on either side of the teeth. When the teeth are seated within a hollow shell which is open at its base, the teeth are secured at their distal end to at least one side of the shell by welding or by gluing. Thus apertures may be present between the distal ends of the teeth at the base of the handle from which they protrude. In accordance with the instant invention, this aperture is sealed or blocked. When the handle is solid, the distal end of each tooth is embedded in the handle and thus sealed into the handle. Examples of such combs useful in the instant invention include those shown in U.S. Pat. No. D 353,915 (Lanne) (such combs are available from ERMO, Cuba 3749. (1429), Buenos Aries, Argentina); in DE 339,538 (Muckenhaupt); and in Argentine Industrial Model 057,522 (Burchakchi) (available from Assistance S. R. L., Leandrono N. Alen 1067 Piso 14, Buenos Aries, Argentina), the disclosure of each of which is incorporated herein by reference.

A device of the instant invention for cleaning the spaces between the teeth is mounted on the teeth. The device is provided with apertures which closely fit each tooth, yet which allow the device apertures sufficient clearance to permit the device to be moved up and down the teeth. The device is comprised of a material which is sufficiently pliable to allow the device to be compressed against the teeth during such movement. Preferably, the device has a means for guiding the teeth into the apertures. Materials, such as for example polypropylene, nylon or high density polyethylene having flow characteristics useful for injection molding techniques may be used. Each device is preferably injection molded to produce the closely spaced apertures for receiving the teeth. However, other methods of manufacture may be used.

BEST MODE OF THE INVENTION

Referring now to FIG. 1, a single comb, generally referenced by the numeral 1000, having a device for cleaning the spaces between the teeth, generally referenced by numeral 900, wherein the device is seated on the teeth, generally referenced as 50 is illustrated. The illustrated apparatus has a handle 101 having a hollow interior from which the teeth 50 protrude through an aperture 103. The teeth are substantially parallel to and spaced apart from one another, forming a layer. The space 70 between teeth is substantially the same between each pair and is sized to receive a strand or a few strands of hair comfortably. Illustrated at the distal end of the teeth proximal to the base is a first embodiment of the device for cleaning the spaces between the teeth 900. This device 900 is shown as a substantially rectangular sheet of a material which is stable in the solvents used to disinfect the comb. The device for cleaning the spaces between the teeth has a plurality of apertures, generally referenced as 910, arranged in a row to easily receive the teeth. The apertures are sized to slidably receive teeth without displacing the teeth from the position held by each at the base of the comb. The device for cleaning the spaces between the teeth is sized to cover any aperture present in the base of the handle; thus when positioned proximal to the base blocks entry of pests. The device preferably extends at least to the edges of the handle at the handle base. After passage of the apparatus through the hair or fur, the device for cleaning the spaces between the teeth is moved by the user from the distal end of each tooth towards the proximal end of each tooth. Preferably, pressure through grasping of the device is applied while moving the device. Pests, their eggs and their egg cases are urged towards the tip of each tooth, from which they are removed. This is accomplished without displacing the teeth, for example without spreading one tooth from the other. Additionally, a means for permanently sealing the aperture 103 which surrounds each of the teeth at their distal end 107 thus filling the aperture may be provided.

Figure 2:
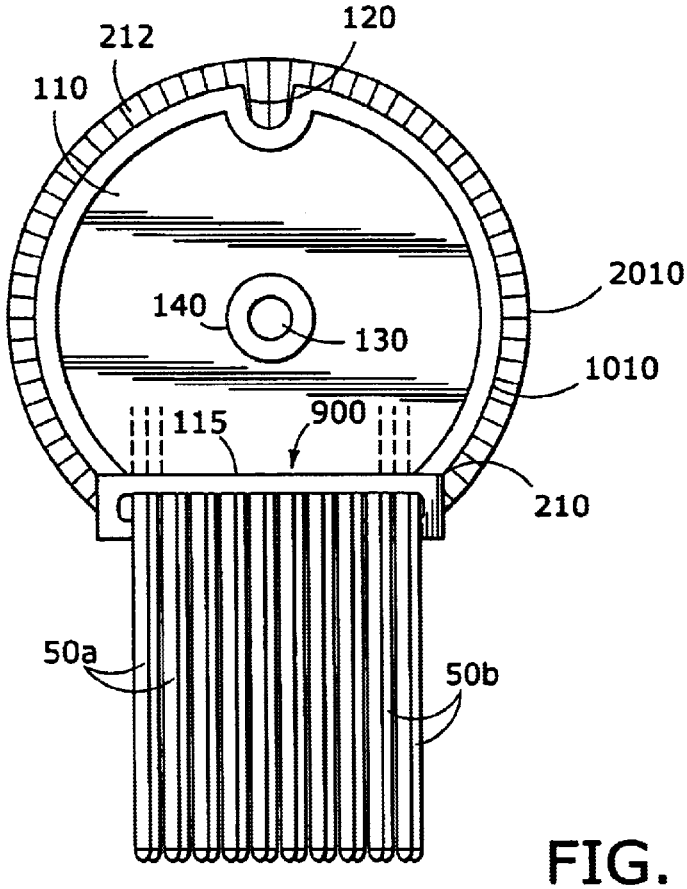
FIG. 2 illustrates a side perspective view of a second embodiment of an apparatus for removing pests from hair and fur comprised of a first and a second comb, wherein the apparatus is shown in the closed position.

Referring now to FIG. 2, a second embodiment of the instant invention illustrating a double comb comprised of two single combs of the type illustrated in FIG. 1 is shown. A first comb, generally referenced by the numeral 1010, has a handle 110, a finger indentation 120 in the handle, a handle pivot point 130 having means for rotation generally referenced as 140, herein a pivot pin inserted therein, and a plurality of elongated teeth 50. A device for cleaning the spaces between the teeth 900, is seated at the base of the first comb handle 1010. The teeth 50 extend from the interior of the first handle. The handle base 115 is preferably closely sealed around the teeth to prevent pests from entering therein. However, the device 900 also prevents pest entry and may be used without the seal. The teeth 50 are closely spaced one to another, yet are not abutting. The width of the space between teeth is in the range of about 0.001 to about 0.005 inches.

Continuing with FIG. 2, pivotally attached to the first comb 1010 is a second comb, generally referenced as 2010. The second comb has a second rounded handle 210 which has a roughened perimeter surface 212 to facilitate contact by a digit for turning the second comb relative to the first comb at a second comb pivot point. A pivot in seated in the pivot point 130 provides for ease of rotation. The pivot pin holds the two combs firmly together when the pivot pin is in the closed position. The second comb also has elongated teeth 50 which extend through an aperture from the interior of the second comb. Each tooth is firmly affixed to an interior face of the second comb. The teeth terminate in blunted endings at their proximal ends. The teeth of the second comb may be the same length or a different length than those of the first comb. Preferably, they are a few millimeters shorter, as illustrated in FIG. 2. The teeth in each comb may be of a substantially equal length or the teeth may be of different lengths so that visually the tips appear to form the points defining an arc. Variations of the pivot pin will be further described in a later FIGS. 8A and 8B.

Figure 3:
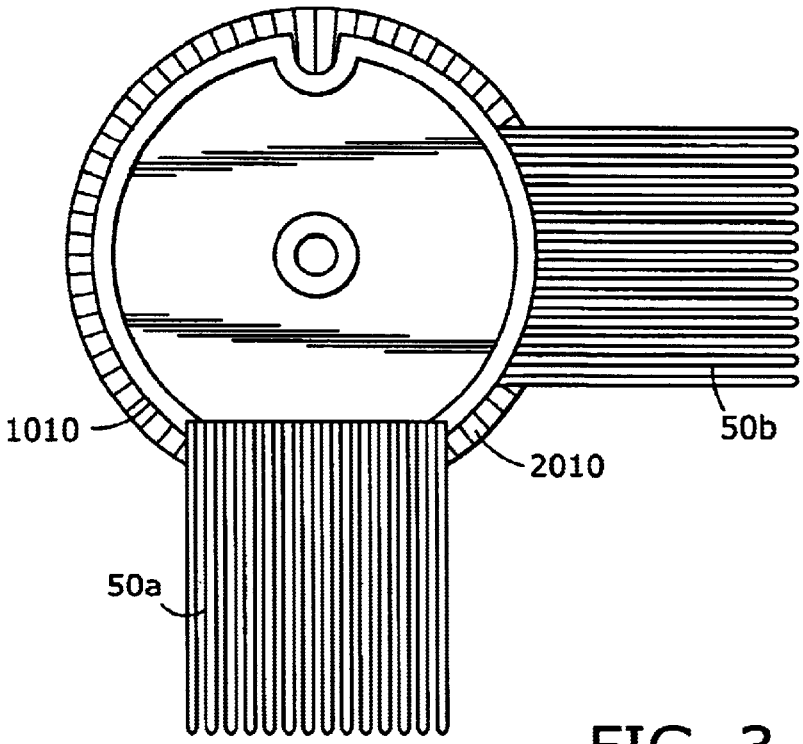
FIG. 3 provides a perspective view of the second embodiment of the apparatus of FIG. 2 in the position for sanitizing.

When the pivot pin is partially released, one comb can be rotated relative to the other. As is illustrated in FIG. 3, the second comb 2010 is rotated at a right angle relative to the first comb 1010. In the rotated position, the apparatus can easily be sanitized by mechanical wiping and washing to remove all pests, their eggs and their egg cases caught therein, by autoclaving or by dipping in a solution which kills pests and eggs without harming humans or any combination of these methods for sanitizing.

Figure 4:
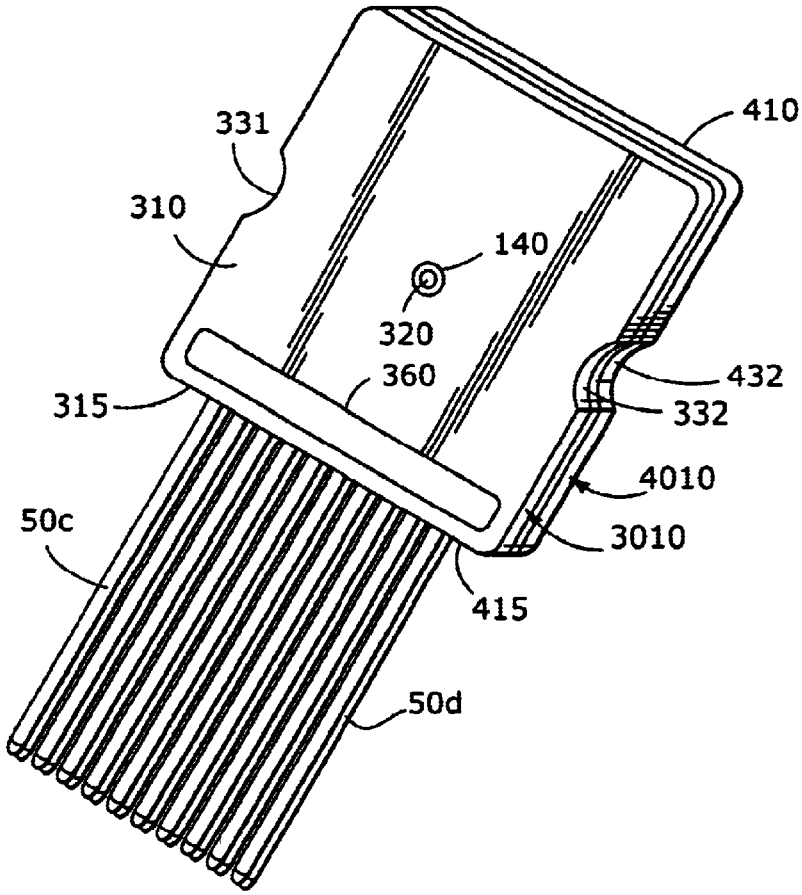
FIG. 4 illustrates a side perspective view of a third embodiment of an apparatus for removing pests from hair and fur comprised of a first comb and a second comb, wherein the apparatus is shown in the closed position.

Referring now to FIG. 4, a second embodiment having a plurality of single combs of the instant invention is illustrated. The first comb, generally referenced as 3010, has a comb handle 310, a pivot point 140 having a pivot point 320 through which is inserted a pivot pin, and a plurality of elongated teeth 50. A second comb, generally referenced as 4010, having a handle 410 shaped similarly to the handle of the first comb 3010, is attached to the first comb at its pivot point through which extends the pivot pin. Each handle has two opposing indentations such as 331, 332 on comb 3010, and 431 (not visible), 432 on comb 4010 respectively, for receiving the tips of fingers. When the pivot pin is released from the closed position, each comb may be gripped at its indentations and rotated with respect to the other. The first handle 310 has a means for gripping 360 the comb, when passing the comb through hair and fur, on its external surface. In FIG. 4, the gripping means has a textured surface. The second handle 4010 may also have a gripping means similarly positioned to that on the first handle 3000. Each comb has elongated teeth 50 which are firmly affixed within the interior of their respective combs. Further both sets of teeth extend from their respective comb at apertures 315, 415 respectively.

Figure 5:
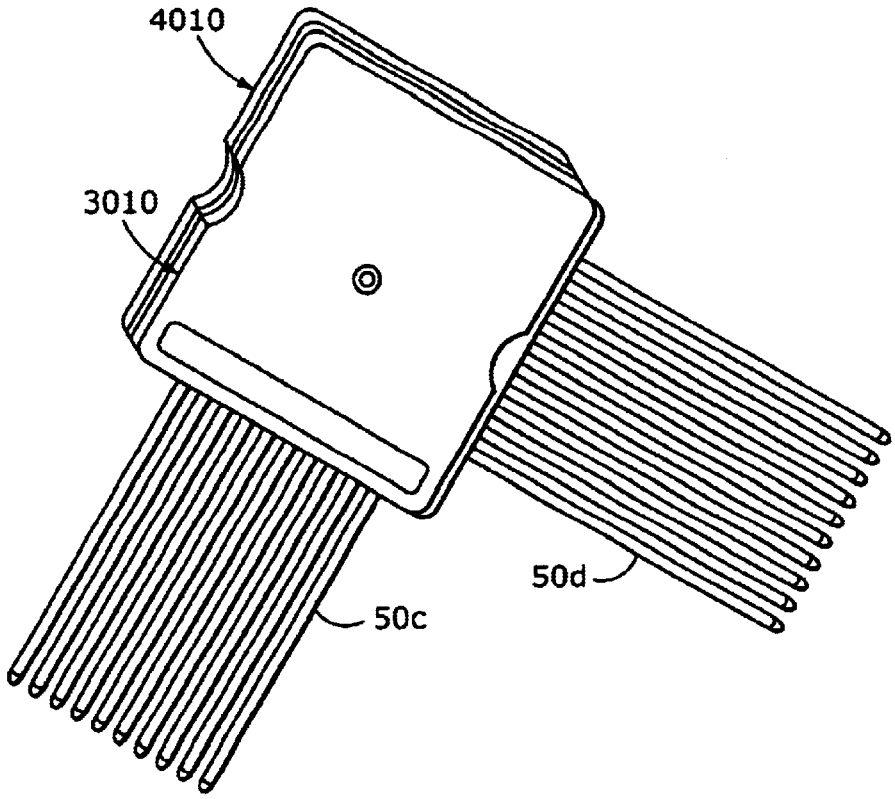
FIG. 5 illustrates a side perspective view of the third embodiment of the apparatus of FIG. 4 wherein the apparatus is positioned for sanitizing.

Referring now to FIG. 5, comb 4010 is shown rotated relative to comb 3010. The comb of FIG. 4 is thoroughly sanitized while in the rotated position, before storage or use by another individual. When a device for cleaning in place on both sets of teeth in the closed position or as individual devices one on each set of teeth, the apparatus may also be rinsed between passages through the hair in alcohol or some other solution which will kill the pests and their eggs without chemical damage to the user, especially where infestation is rampant. The teeth of each comb may also be dipped in a chemical which is non-toxic to humans to facilitate sanitizing between use by different individuals or a combination of the above cleaning methods can be used.

Figure 6:
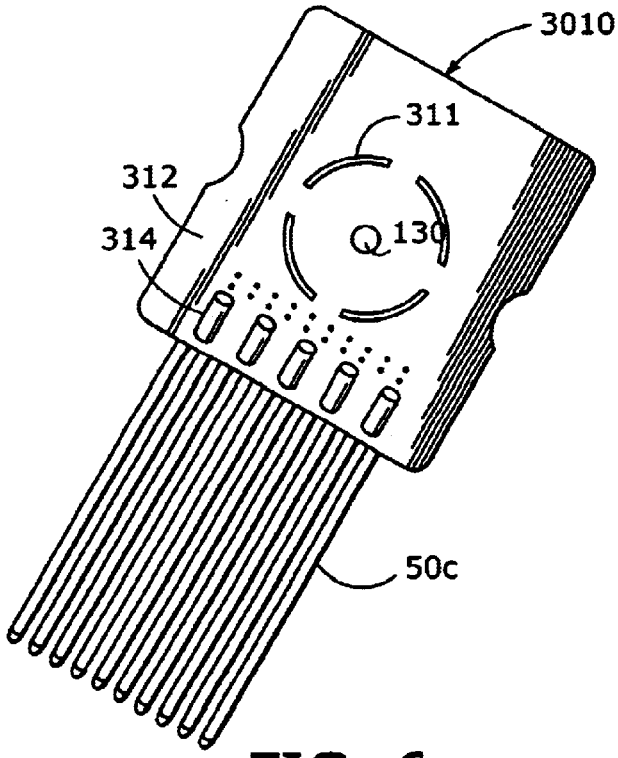
FIG. 6 illustrates a side perspective view of the exterior surface of the interior external face of the first comb of the apparatus of FIG. 4.

FIG. 6 illustrates the exterior surface of the interior face of comb 3010. Surrounding the pivot point 130 is a raised circular area 311 having openings in the circle. Below the pivot point 130, an area of arc welding 312 is shown, representing where the teeth 50 have been arc welded to the comb interior. Alternatively (not shown here), teeth may be affixed to the interior surface of a face of a comb having a hollow interior using a water-insoluble glue such as an epoxy, especially when the aperture at the base of the handle is scaled. Below the arc welded area are a plurality of protrusions 314.

Figure 7:
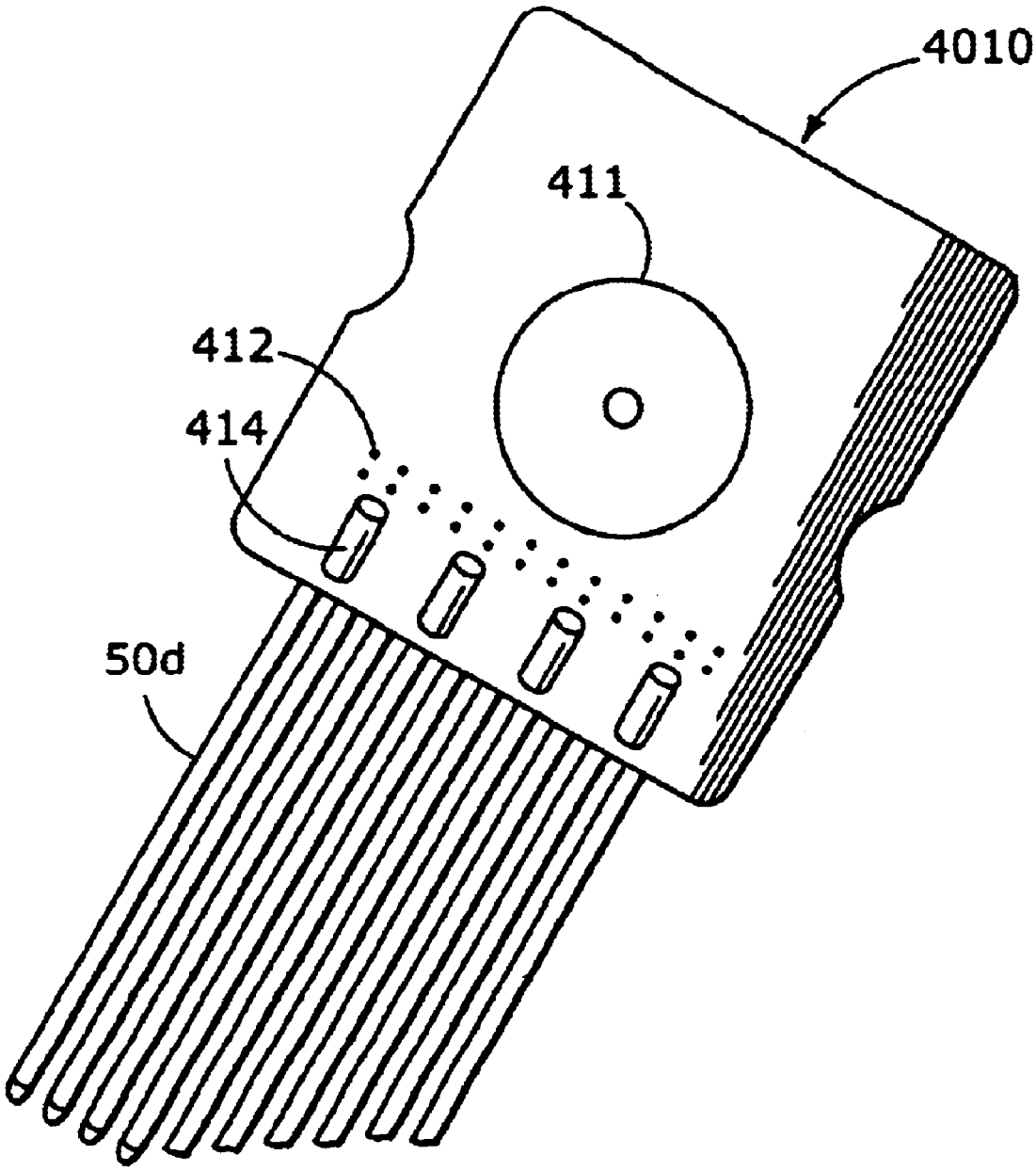
FIG. 7 illustrates a perspective side view of the exterior surface of the interior external face of the second comb of the apparatus of FIG. 4.

FIG. 7 illustrates the exterior surface of the interior external face of comb 4010. Surrounding the pivot point is a raised circular area 411. This area can be mated with the circular area of comb 3010 thereby providing a guide for rotation. Below the circular, or alternatively crescent shaped area (not shown), is an area of arc welding 412 where the teeth 50 have been welded to the comb interior. Below the arc welded area are a plurality of protrusions 414. These protrusions are spaced so that each protrusion fits between two protrusions on the exterior surface of the interior external face of comb 3010. The protrusions are spaced so that the protrusions of one comb 3010 can be snapped together with the protrusions on the other comb 4010, when the fastener means is tightened into the closed position. Thus, the two combs may be stabilized one to the other; yet the protrusions are of a height such that when uncoupled, the protrusions do not hinder rotation of the combs. As will be clear to one skilled in the art, various means can be used to provide a guide for rotation and to provide a means for stabilizing a first comb 3010 to a second comb 4010. For example, a raised area may be mated with a recessed or grooved area.

Figure 8A:
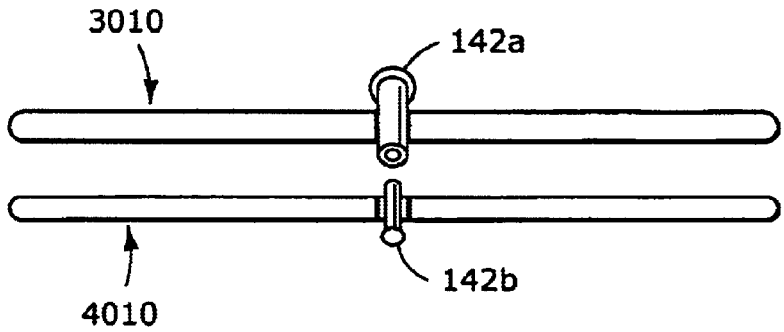
FIG. 8A illustrates a side perspective of an exploded view of a first embodiment of a fastener means comprised of a hollow pin and a solid pin the combination of which acts as a pivot pin useful for stabilizing the first comb and the second comb of the apparatus when the apparatus is in the closed position.
Figure 8B:
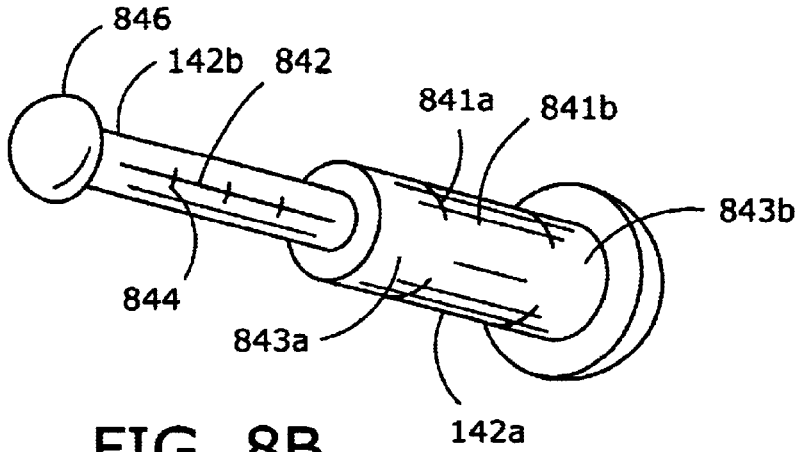
FIG. 8B illustrates the interior of a hollow pin and the exterior surface of a solid pin of FIG. 8A.

Referring now to FIGS. 8A and 8B, one embodiment of the fastener means for coupling a first comb such as 3010 to a second comb such as 4010, or to a plurality of additional combs, is illustrated. FIG. 8A shows a fastener means 140 which in this illustration is a pivot pin 142*a*, 142*b* respectively protruding through a pivot point in each respective comb. In FIG. 8B, the first and second sections of the pivot pin, 142*a* and 142*b* respectively, are shown in an exploded cross-sectional view. As can be seen, the first pivot pin section 142*a* has a larger diameter than the second section, 142*b*, so that 142*b* may be fitted into the interior of 142*a*. The first pivot pin section 142*a* is hollow and has annular rings, 841*a* and 841*b*, each of which has a slot or opening, 843*a* and 843*b* respectively. The second pivot pin section, 142*b*, has a ridge 842 which extends from the pivot pin tip towards the pivot pin head 846. At intervals on the ridge 842, are bars such as 844, which are at right angles to the ridge. The ridges are sized to fit into the slots of 142*a*. When the second section 142*b* is fitted into the first section 142*a* so that a bar 844 is coupled to a slot 843*a* and the one pivot section is twisted relative to the other section, the two sections lock together. Other fastener means which can be used are known to those skilled in the art, for example a nut and screw, an extendible rivet and the like. Such fastener means may be used instead of a pivot pin as desired.

Figure 9A:
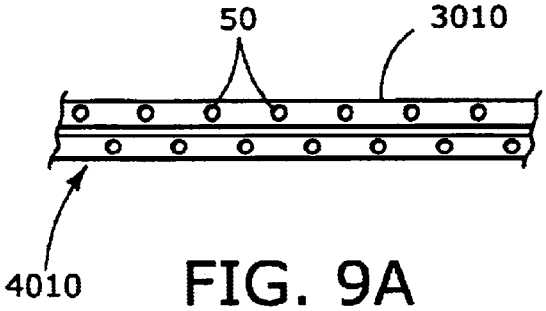
FIG. 9A illustrates a bottom view of the apparatus of FIG. 4 at the base of the handle from which the teeth protrude in the absence of the device for cleaning the spaces between the teeth.
Figure 9B:
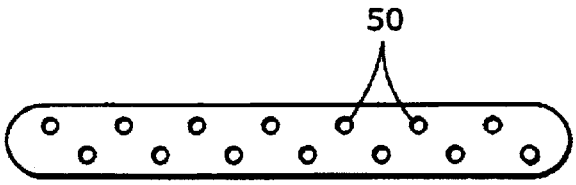
FIG. 9B illustrates a bottom up perspective view of the placement of two layers of teeth in a single handled comb.

FIGS. 9A and 9B illustrate the spacing of the teeth in two embodiments of the instant invention. Referring to FIG. 9A, a comb comprises of two single combs is illustrated. Referring to FIG. 9B, the spacing of the teeth on a single comb having a plurality of layers of teeth is illustrated. It can be seen that the teeth are rounded and are closely spaced, yet the teeth do not immediately abut one another. Further, it can be seen in FIG. 9A that the teeth of comb 3010 and the teeth of comb 4010 are aligned so that the teeth of one comb are substantially staggered relative to the teeth of the opposing comb. When a single comb having a plurality of layers of teeth is provided, the teeth are arranged in parallel layers which are staggered one layer from the other.

Figure 10A:
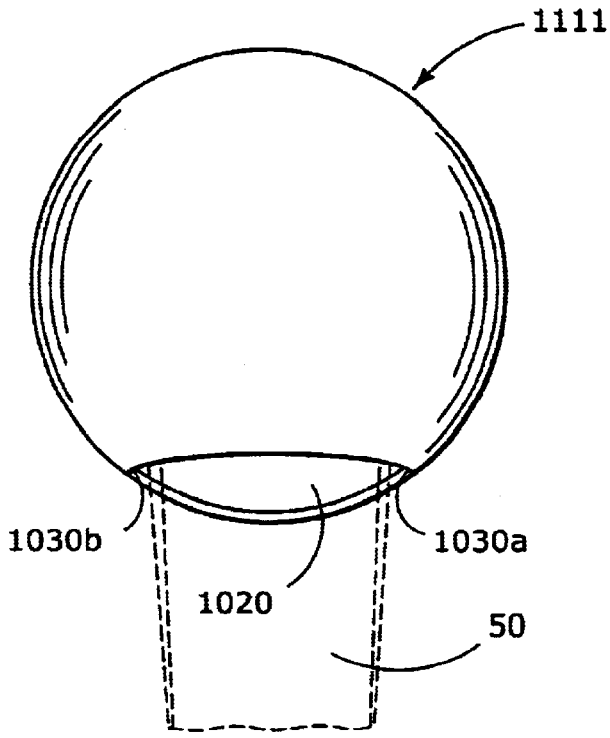
FIG. 10A illustrates in a top down perspective view a first embodiment of a casing for an apparatus for the mechanical removal of pests and their eggs from hair and fur.
Figure 10B:
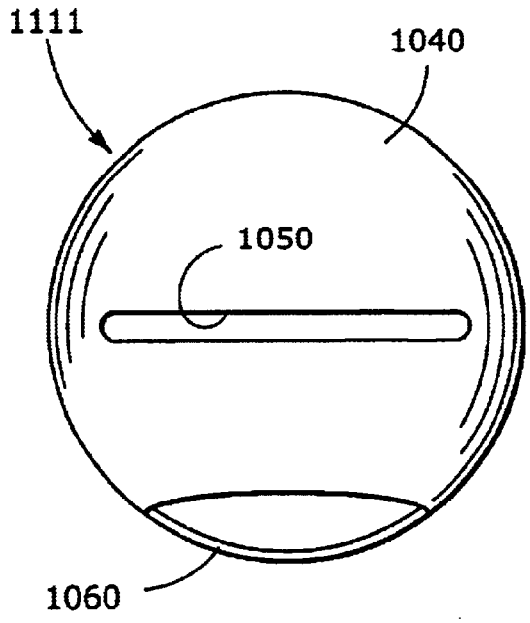
FIG. 10B illustrates in a top down perspective view a second embodiment of a casing for an apparatus for the mechanical removal of pests and their eggs from hair and fur.
Figure 10C:
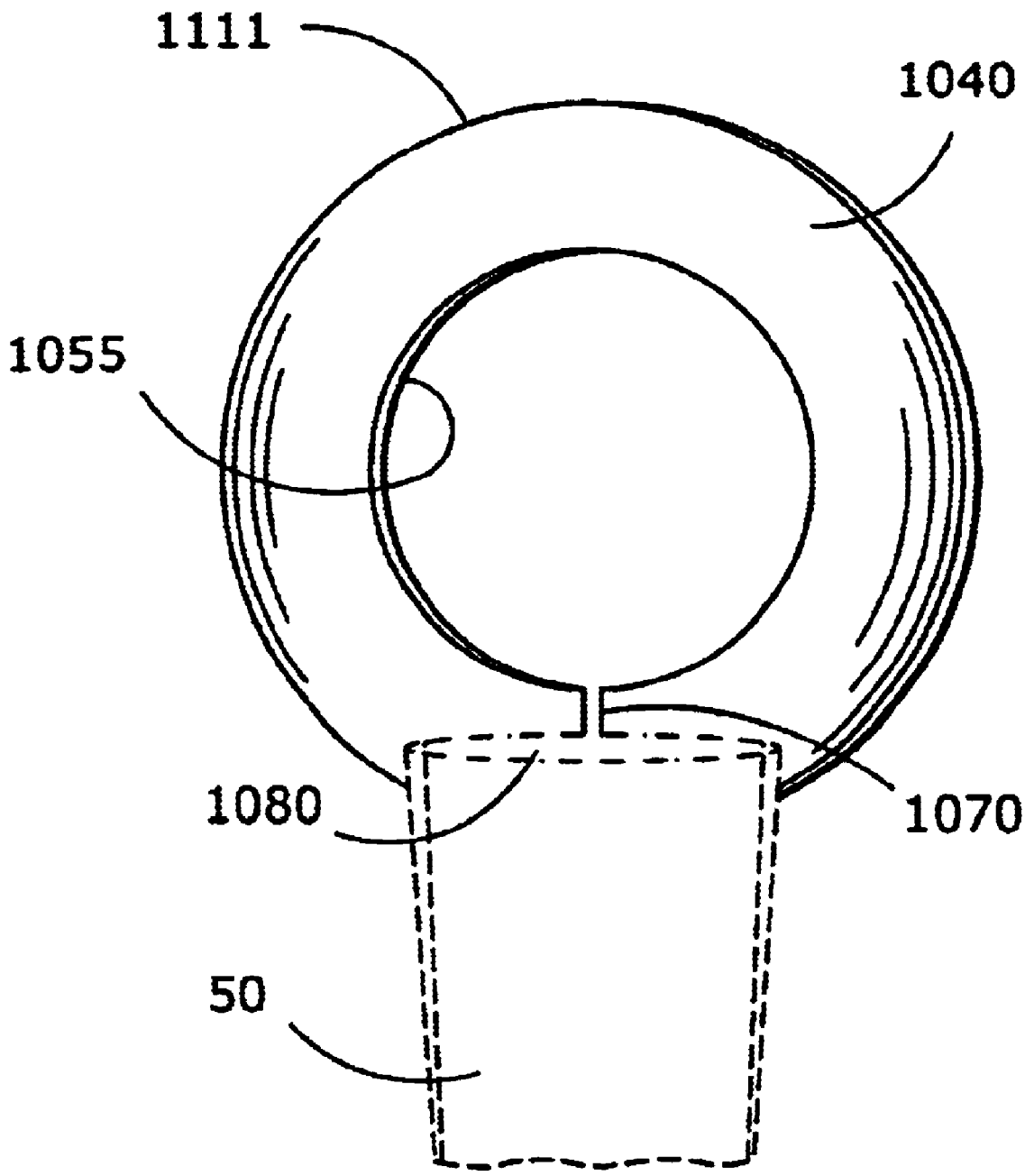
FIG. 10C illustrates in a top down perspective view a third embodiment of a casing for an apparatus for the mechanical removal of pests and their eggs from hair and fur.

Referring now to FIGS. 10A, 10B, 10C and 10D, an alternative means to stabilize a first comb to a second comb or to facilitate gripping the handle and enhance visual appeal is provided as a handle cover. The handle cover may be placed over an individual comb or a plurality of combs. The handle cover is comprised of an elasticized or flexible material such as rubber, plastic, or nylon which will conform to the shape of the handle after being stretched to fit the handle(s). The handle cover may be textured or embossed. The casing for the comb is injection molded of an elastic, flexible material such as polypropylene, high density polyethylene or nylon. The material must have enough strength to allow the casing to be stretched around the appropriate area of the comb or combs, while being elastic enough to conform to the shape of the handle once the casing is in place. Various embodiments of such a handle cover are shown in FIGS. 10A, 10B, and 10C.

As shown in FIG. 10A, the cover, generally referenced as 1111, is sized to fit a comb handle. At the base of the cover is an opening 1020 having a side closure means 1330*a* and 1330*b*. The cover may be stretched and slipped over the top most portion of the comb handle, then pulled down over the handle. Once the handle is secured within the cover with the teeth 50 protruding through the opening, the side closure means fits or is fitted into place on either side of the teeth so that the appropriate side closure means end is proximal to the first tooth on the first side closure end 1330*a* and is proximal to the last tooth on the second side closure means end 1330*b*. Thus, the base of the comb handle on either side of the teeth is covered. A plurality of combs may enclosed in a similar casing.

In FIG. 10B, wherein the comb is slipped through an opening 1050 in the face 1140 of the cover 1110, teeth first, the teeth are then fitted through the opening 1060 and the cover 1110 is stretched to receive the handle. Alternatively as is shown in FIG. 10C, the cover 1110 at the cover face 1140, has a circular opening 1055 from which extends a vertical slit 1170. The base of the cover has a horizontal slit 1180 at the cover base. The cover is separated at the slits and fitted to the comb handle with the teeth 50 protruding through the horizontal slit 1180. Alternatively, a casing may be provided which grips only the edges of the comb or combs.

To use the comb having a fastener means for self removal of pests, the combs are aligned so that the teeth all point in the same direction. When the fastener means is a pivot pin, the pivot in is tightened to secure the individual combs one to the other. When a casing is used to mate and stabilize one comb to another, the teeth of the plurality of combs are arranged in staggered layers one to the other, then the casing is fitted to the handles to hold them in place. Next, the teeth of the joined combs are passed through the hair or fur such that individual or small numbers of strands of hair pass between the teeth thereby gleaning the pests, their eggs and eggcases from the strands of hair.

Figure 11A:
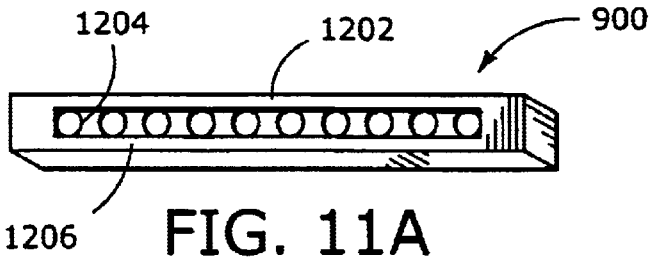
FIGS. 11A and 11B illustrate perspective views of embodiments of a device for cleaning the spaces between the teeth for an apparatus such as shown in FIG. 1, wherein the apparatus has a single layer of substantially parallel spaced apart teeth.
Figure 11B:
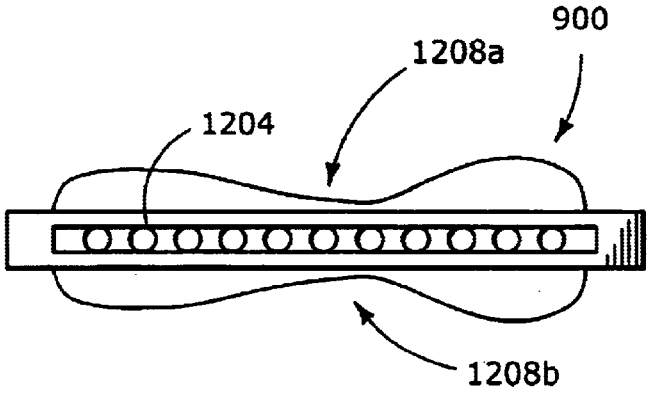
Figure 11C:
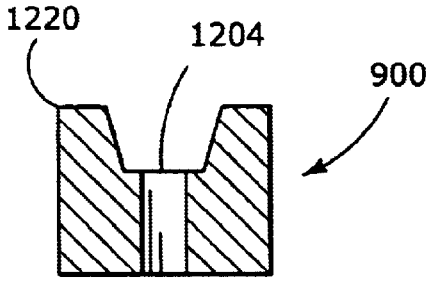
FIG. 11C illustrates the device of FIG. 11A in cross-section.
Figure 11D:
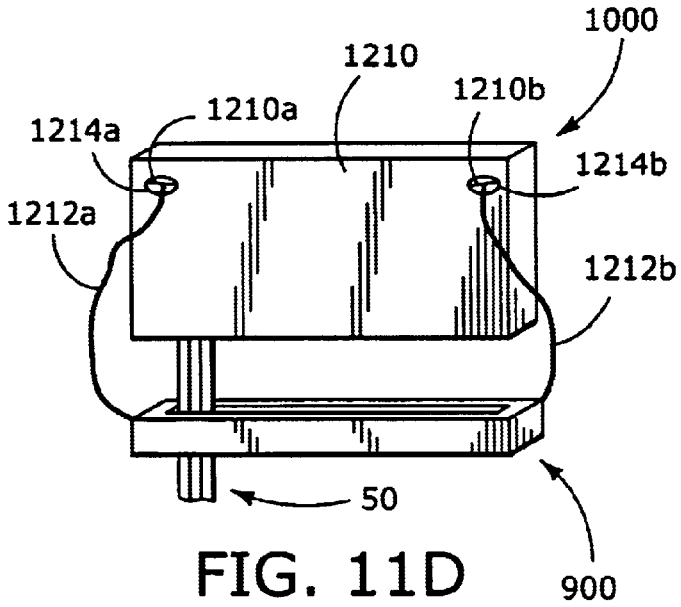
FIG. 11D illustrates a perspective view of the device of FIG. 11A seated on the teeth of a comb wherein the device has a means for securing the device to a comb.

FIGS. 11A, 11B, and 11D show various configurations of the device for cleaning the spaces between the teeth for a single comb. FIG. 11C illustrates a cross-sectional view of the device showing a means for guiding the teeth into the apertures. Referring now to FIG. 11A, the device is illustrated in its simplest form. The device has a planar base 1202 with a series of apertures 1204 equal in number to the number of teeth on the comb to which the device is fitted. Each aperture is aligned and sized to receive a tooth from a layer or row of teeth. Sufficient area 1206 is provided surrounding the apertures to allow the planar base to be gripped easily for sliding up and down the teeth. Either the planar base is made of a material which allows precision sizing and spacing of the apertures, and/or it is shaped so as to facilitate substantially equal distribution of the pressure to the teeth when force is applied by gripping the planar base or both. As illustrated in FIG. 11B, this shape may be similar to that of a bowtie wherein the fingers are placed in the center indentations 1208*a* and 1208*b* respectively, to apply pressure while the device is moved along the teeth. Referring now to FIG. 11C, a cross-section of the device is provided. The apertures for receiving the teeth are set at a depth. The shoulders of the device leading to the planar area in which the apertures are seated has a slope to aid in guiding the teeth into the apertures. The shoulders or edges of the device may extend upward into lip which may be sized to receive the base of the handle of the comb so that the device may be held in place at the base of the comb during passage of the comb through the hair.

As in previous examples, the device may be removable from the teeth or the device may be provided with a means for securing the device to the comb so that the teeth cannot easily be removed from the apertures without releasing the securing means. An example of such as securing means is illustrated in FIG. 11D. As shown, the handle of the comb is provided with holes, 1210*a* and 1210*b* respectively, in each of the upper comers of the handle. The device is provided with extensions 1212*a* and 1212*b* respectively, having tabs, 1214*a* and 1214*b*, which extend from the planar base 1202 through the holes. The tabbed extensions should be long enough to allow the planar base to move from a position proximal to the base of the handle down to the proximal ends of the teeth. The tabs should releasably hold the extensions to the handle at the holes.

Figure 11E:
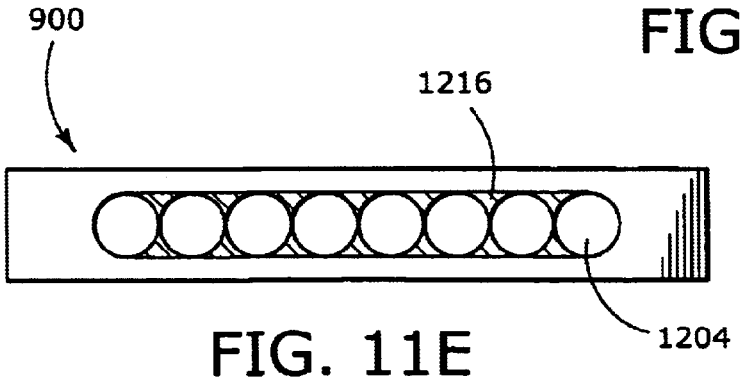
FIG. 11E illustrates a perspective views of an embodiment of a device for cleaning the spaces between the teeth for an apparatus such as shown in FIG. 1, wherein the apparatus has a single layer of substantially parallel spaced apart teeth.

FIG. 11E illustrates a further embodiment of the cleaning device of FIG. 11A. In this embodiment, the device has a series of apertures 1204 equal in number to the number of teeth on the comb to which the device is fitted. Each aperture is aligned and sized to receive a tooth from a layer or row of teeth with each aperature separated by a conforming portion 1216 adapted to closely surround each tooth for cleaning.

Figure 12:
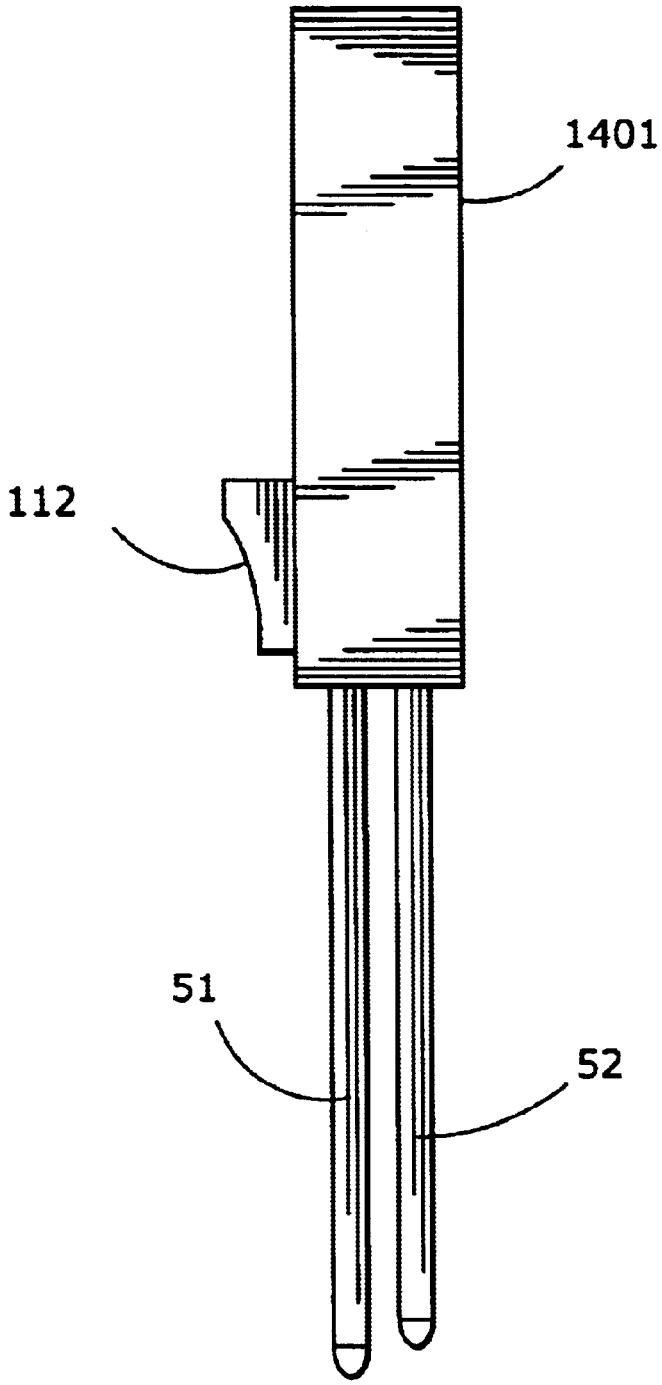
FIG. 12 illustrates a perspective side view of a fourth embodiment of the instant invention which provides a single comb having two layers of teeth embedded in a solid handle where a single device for cleaning the spaces between the teeth is seated on both layers of teeth. Also illustrated on the comb is an area proximal to the base of the comb to facilitate gripping of the comb.

FIG. 12 shows a single comb having a plurality of layers of teeth 51, 52 respectively, in side view to clearly show a protrusion 1401 which is seated on the handle 112 proximal to the handle base. This protrusion is provided to enhance gripping of the comb during use.

The foregoing is considered only illustrative of the currently preferred embodiments of the invention presented herein. Since numerous modifications and changes will occur to those skilled in the art, it is not desired to limit the invention to the exact construction used to illustrate the various means comprising this invention.

What is claimed is:

1. An apparatus for the mechanical removal of pests and their eggs from hair and fur, said apparatus comprising:

a first handle and a second handle, each of said first handle and said second handle having a base at least one of said first handle and said second handle having a closely sealed aperture at its base, wherein said first handle and said second handle each have an interior surface and each said interior surface has a guide for rotating said first handle relative to said second handle;

a plurality of teeth arranged in a layer, each tooth of said layer protruding from one of said first handle and said second handle, each tooth separated from the next tooth by a space sized to receive a strand of hair, each tooth being hollow and having a blunt proximal end each tooth having a length sufficient to allow said tooth to vibrate when contacting a cluster of pests; and a pivot pin having an open and a closed position, wherein said first handle is rotatable relative to said second handle when said pivot pin is in the open position, and wherein said first handle and said second handle are locked together when said pivot pin is in the closed position.

2. A method of diagnosing an infestation of pests or pest eggs in an individual, comprising:

passing a lice comb through the hair of the individual, the lice comb comprising:

a first layer of teeth arrange so that each tooth in said first layer is substantially parallel to an adjacent first layer tooth, the teeth having separations therebetween sized to accomodate a few hairs;

a second layer of teeth arranged so that each tooth in said second layer is substantially parallel to an adjacent second layer tooth, the teeth having separations therebetween sized to accomodate a few hairs, wherein said first layer and said second layer are substantially parallel and shifted one to the other; and a plate having two parallel rows of spaced apertures, each aperture sized to receive one of said teeth, wherein said plate is seated upon both of said first layer of teet and said second layer of teeth, and inspecting the comb for the presence of pests or pest eggs.

3. The method of claim 2, wherein the individual passes the apparatus through his or her own hair.

4. A method of diagnosing an infestation of pests or pest eggs in an individual, comprising:

passing a lice comb through the hair of the individual, the lice comb comprising:

a plurality of teeth, each tooth separated by a space from each adjacent tooth, the space being sized to accomodate a few hairs; and a means for removing said pests and said pest eggs from said plurality of teeth and from said space;

using the removing means to remove pests or pest eggs from said teeth and said space; and inspecting the removing means for the presence of pests or pest eggs.

5. The method of claim 4, wherein the individual passes the apparatus through his or her own hair.

* * * * *